US012392221B2

(12) United States Patent
Anzi et al.

(10) Patent No.: US 12,392,221 B2
(45) Date of Patent: Aug. 19, 2025

(54) CONTROLLING FLUID FLOWS IN A MULTI-WELLBORE WELL SYSTEM WITH A SURFACE CONTROLLED FORMATION ISOLATION VALVE

(71) Applicant: Saudi Arabian Oil Company, Dhahran (SA)

(72) Inventors: Abdulrahman Mamdouh Anzi, Al Khafji (SA); Mohammed Hadi Alqahtani, Al Khafji (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/103,797

(22) Filed: Jan. 31, 2023

(65) Prior Publication Data

US 2024/0254862 A1 Aug. 1, 2024

(51) Int. Cl.
*E21B 34/16* (2006.01)
*E21B 47/12* (2012.01)

(52) U.S. Cl.
CPC ..... *E21B 34/16* (2013.01); *E21B 47/12* (2013.01)

(58) Field of Classification Search
None
See application file for complete search history.

(56) References Cited

U.S. PATENT DOCUMENTS 5,331,270 A * 7/1994 Nutz ..... H03K 17/13 323/237
5,531,270 A * 7/1996 Fletcher ..... E21B 41/0035 166/319

(Continued)

FOREIGN PATENT DOCUMENTS

| | | |
|---|---|---|
| CA | 2224258 | 8/2006 |
| RU | 2540762 | 2/2015 |
| WO | WO 2019017921 | 1/2019 |

OTHER PUBLICATIONS

Adams et al., "Methodology for Optimum Deepwater Safety System Selection," Prepared for presentation at the AADE 2001 National Drilling Conference, "Drilling Technology—The Next 100 years", Mar. 27-29, 2001, 1-4, 4 pages.

(Continued)

*Primary Examiner* — Nicole Coy
*Assistant Examiner* — Douglas S Wood
(74) *Attorney, Agent, or Firm* — Fish & Richardson P.C.

(57) ABSTRACT

A method and systems controlling fluid flow in a multi-wellbore well system with a surface controlled formation isolation valve in a well system requiring an intervention job. The method includes transmitting, from a control panel on a surface of the Earth, the control panel operatively coupled to the well system, a control signal to a surface controlled formation isolation valve positioned in the well system at a downhole location and configured to control a fluid flow from a motherbore into a production tubing. The method includes receiving, at the surface controlled formation isolation valve, the control signal. The method includes after receiving the control signal at the surface controlled formation isolation valve, opening the surface controlled formation isolation valve hydraulically. The method includes after opening the surface controlled formation isolation valve, the required intervention job can be conducted.

24 Claims, 2 Drawing Sheets

(56) References Cited

U.S. PATENT DOCUMENTS

| | | | | |
|---|---|---|---|---|
| 5,823,263 | A * | 10/1998 | Morris | E21B 34/10 166/387 |
| 5,955,666 | A * | 9/1999 | Mullins | E21B 43/14 340/853.2 |
| 5,959,547 | A * | 9/1999 | Tubel | E21B 47/107 340/853.2 |
| 5,960,883 | A * | 10/1999 | Tubel | E21B 44/00 166/313 |
| 6,012,015 | A * | 1/2000 | Tubel | E21B 47/12 702/6 |
| 6,012,105 | A * | 1/2000 | Rubbmark | H04M 1/72409 710/14 |
| 6,419,022 | B1 * | 7/2002 | Jernigan | E21B 43/14 166/336 |
| 6,666,271 | B2 | 12/2003 | Deaton et al. | |
| 8,235,127 | B2 * | 8/2012 | Patel | E21B 43/14 166/242.6 |
| 9,010,448 | B2 | 4/2015 | Williamson, Jr. et al. | |
| 9,404,333 | B2 | 8/2016 | Patel | |
| 10,794,148 | B2 | 10/2020 | Williamson | |
| 11,365,603 | B2 * | 6/2022 | Al-Mousa | E21B 34/16 |
| 11,396,791 | B2 | 7/2022 | Johnson | |
| 2001/0013412 | A1 * | 8/2001 | Tubel | E21B 34/066 340/856.1 |
| 2002/0179303 | A1 * | 12/2002 | Maxit | E21B 47/12 166/373 |
| 2003/0227393 | A1 * | 12/2003 | Vinegar | E21B 34/066 340/854.3 |
| 2019/0128080 | A1 * | 5/2019 | Ross | E21B 49/00 |
| 2020/0141506 | A1 * | 5/2020 | Holder | E21B 34/10 |

OTHER PUBLICATIONS

Cdn.brandfolder.io [online], "Self-Equalizing Feature," Halliburton, Subsurface Safety Equipment Brochure, Available on or before Sep. 2, 2018, retrieved on Mar. 21, 2024, URL <https://cdn.brandfolder.io/OUSGG99Q/as/jp2jpj82s8mh5cwq9wsw4/Subsurface_Safety_Valves Equipment.pdf>, 42 page.

Jpt.spe.org [online], "Surface-Controlled Formation-Isolation Valves Used for Temporary Well Suspension," Mar. 31, 2014, retrieved on Dec. 8, 2023, URL <https://jpt.spe.org/surface-controlled-formation-isolation-valves-used-temporary-well-suspension>, 10 pages.

* cited by examiner

CONTROLLING FLUID FLOWS IN A MULTI-WELLBORE WELL SYSTEM WITH A SURFACE CONTROLLED FORMATION ISOLATION VALVE

TECHNICAL FIELD

This disclosure relates to multi-wellbore flow control operation.

BACKGROUND

Wellbores in an oil and gas well conduct liquid and gaseous phases of various fluids and chemicals including water, oils, and hydrocarbon gases from subterranean formations to a surface of the Earth. The fluids and gases in the wellbore can be pressurized. A wellbore pressure control system is installed on the wellbore to seal the wellbore and to control the flow of oil and gas from the wellbore. The wellbore pressure control system can include inflow control valves to control the flow of oil and gas by forcing the flow of oil and gas from the wellbore to the inflow control valves.

SUMMARY

This disclosure describes systems and methods related to controlling fluid flow in a multi-wellbore well system with a surface controlled formation isolation valve. This approach controls fluid flow in a multi-wellbore well system with a surface controlled formation isolation valve in a well system requiring an intervention job.

In one aspect, the method includes transmitting, from a control panel on a surface of the Earth, the control panel operatively coupled to the well system, a control signal to a surface controlled formation isolation valve positioned in the well system at a downhole location to control a fluid flow from a motherbore into a production tubing. The method includes receiving, at the surface controlled formation isolation valve, the control signal. The method includes operating, based on the control signal, the surface controlled formation isolation valve to control the fluid flow from the motherbore into the production tubing. The method includes performing the intervention job on the well system.

In some implementations, transmitting the control signal to the surface controlled formation isolation valve includes conducting the control signal via a surface controlled formation isolation valve control line electrically coupling the control panel to the surface controlled formation isolation valve.

In some implementations, the control signal includes at least one of an open control signal or a close control signal. In some cases, operating the surface controlled formation isolation valve responsive to receiving the open control signal at the surface controlled formation isolation valve includes opening the surface controlled formation isolation valve.

In some implementations, the method further includes, responsive to opening the surface controlled formation isolation valve, conducting a flow of the fluid from the at least one of multiple subterranean formations of the Earth through the motherbore into the production tubing positioned in the motherbore. The production tubing fluidly couples the motherbore to a wellhead positioned on the surface. In some cases, operating the surface controlled formation isolation valve responsive to receiving the close control signal at the surface controlled formation isolation valve includes closing the surface controlled formation isolation valve.

In some implementations, the method further includes responsive to closing the surface controlled formation isolation valve, stopping a flow of fluid from the at least one of the subterranean formations through the motherbore into the production tubing. In some cases, when the surface controlled formation isolation valve is closed, method the further includes operating a motherbore inflow control valve positioned in the motherbore to control the flow of the fluid from the motherbore into the production tubing and operating a lateral inflow control valve positioned in the motherbore to control a flow of another fluid from the lateral wellbore into the production tubing.

In some implementations, the method further includes transmitting, from a single well completion panel positioned at the surface of the Earth, the single well completion panel operatively coupled to the motherbore inflow control valve and the lateral inflow control valve, another control signal via an inflow control valve line to the motherbore inflow control valve and the lateral inflow control valve to operate the motherbore inflow control valve and the lateral inflow control valve. The method further includes receiving, at the motherbore inflow control valve and the lateral inflow control valve via an inflow control valve line to the motherbore inflow control valve and the lateral inflow control valve, the another control signal.

In some implementations, the method further includes sensing a safety condition in the motherbore; and responsive to sensing the safety condition in a portion of the motherbore, operating via the control panel, a sub-surface safety valve positioned in the motherbore to isolate the motherbore.

In another aspect, a well system includes a motherbore, a lateral wellbore fluidly coupled to the motherbore, a surface controlled formation isolation valve, and a control panel. The motherbore extends from a surface of the Earth into multiple subterranean formations. The motherbore is fluidly coupled to at least one of the subterranean formations to receive a fluid from at least one of the subterranean formations. The lateral wellbore extends from the motherbore at a location between the downhole end of the motherbore and the surface. The lateral wellbore is fluidly coupled to at least another one of the multiple subterranean formations to receive another fluid from the at least another one of the subterranean formations. The surface controlled formation isolation valve is positioned in the motherbore to control a fluid flow from the motherbore into the production tubing. The control panel is positioned in a space above the surface. The control panel is operatively coupled to the well system and the surface controlled formation isolation valve.

In some implementations, the control panel performs operations including transmitting the control signal to the surface controlled formation isolation valve.

In some implementations, the well system further includes a surface controlled formation isolation valve control line electrically coupling the control panel to the surface controlled formation isolation valve. The surface controlled formation isolation valve control line conducts the control signal from the control panel to the surface controlled formation isolation valve. In some cases, the surface controlled formation isolation valve control line can be a hydraulic control line hydraulically coupling the control panel to the surface controlled formation isolation valve. The surface controlled formation isolation valve hydraulic control line conducts hydraulic fluid from the control panel to the surface controlled formation isolation valve as a hydraulic control signal to hydraulically open and close the surface controlled formation isolation valve.

In some implementations, the control signal includes at least one of an open control signal or a close control signal.

In some implementations, the well system further includes a production tubing positioned in the motherbore. The production tubing extends from the surface through the motherbore to a location downhole from the lateral wellbore. In some cases, the well system further includes a wellhead assembly coupled to the motherbore at the surface. The wellhead assembly controls the fluid flow from the motherbore.

In some cases, the well system further includes a first packer and a second packer. The first packer is positioned in the motherbore uphole from the lateral wellbore. The second packer is positioned in the motherbore downhole from the lateral wellbore and uphole from the surface controlled formation isolation valve.

In some implementations, the well system further includes a motherbore inflow control valve and a lateral inflow control valve. The motherbore inflow control valve is coupled to the production tubing and positioned in the motherbore uphole of the surface controlled formation isolation valve and downhole of the second packer. The motherbore inflow control valve controls the fluid flow from the motherbore into the production tubing. The lateral inflow control valve is coupled to the production tubing and positioned in the motherbore between the first packer and the second packer. The lateral inflow control valve controls the flow of the another fluid from the lateral wellbore into the production tubing. In some cases, the well system, further includes a single well completion panel and an inflow control valve line. The single well completion panel is positioned in the space outside the wellbore. The single well completion panel is operatively coupled to the motherbore inflow control valve and the lateral inflow control valve. The inflow control valve line operatively couples the single well completion panel to the motherbore inflow control valve and the lateral inflow control valve.

In some implementations, the well system further includes a sub-surface safety valve positioned in the motherbore to isolate a portion of motherbore from the space outside the well system.

In some implementations, the well system further includes an emergency shutdown system coupled to the surface controlled formation isolation valve. The emergency shutdown system hydraulically operates the surface controlled formation isolation valve.

Implementations of the present disclosure can realize one or more of the following advantages. These systems and methods can decrease total wellbore maintenance time. For example, conventionally, production of the wellbore is secured, a workover rig is positioned above the wellbore, and a shifting tool is deployed into the wellbore to reposition the formation isolation valve. These operations can be time-consuming. Opening and closing the formation isolation valve remotely from a controller on the surface can eliminate securing production of the wellbore, positioning the workover rig, and deploying the shifting tool, which can reduce the time required for wellbore maintenance.

These systems and methods can improve personnel safety. For example, eliminating positioning the workover rig, and deploying the shifting tool, which can be dangerous operations to personnel, can improve personnel safety. In addition, mechanical formation isolation valve shifting operations can be performed offshore without a drilling rig, utilizing a barge, which can be a costly operation.

These systems can eliminate using a rig to shift a mechanical formation isolation valve. For example, a surface control panel can be utilized with rig-less operations and without additional field services personnel. Eliminating using a rig and additional field service personnel can eliminate the cost associated with running coiled tubing operations to shift the mechanical formation isolation valve from a closed position to an open position. Eliminating using a rig and additional field service personnel can, in effect, reduce man-hours exposure to hazardous critical operations and maintain wellbore accessibility as per engineering needs.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
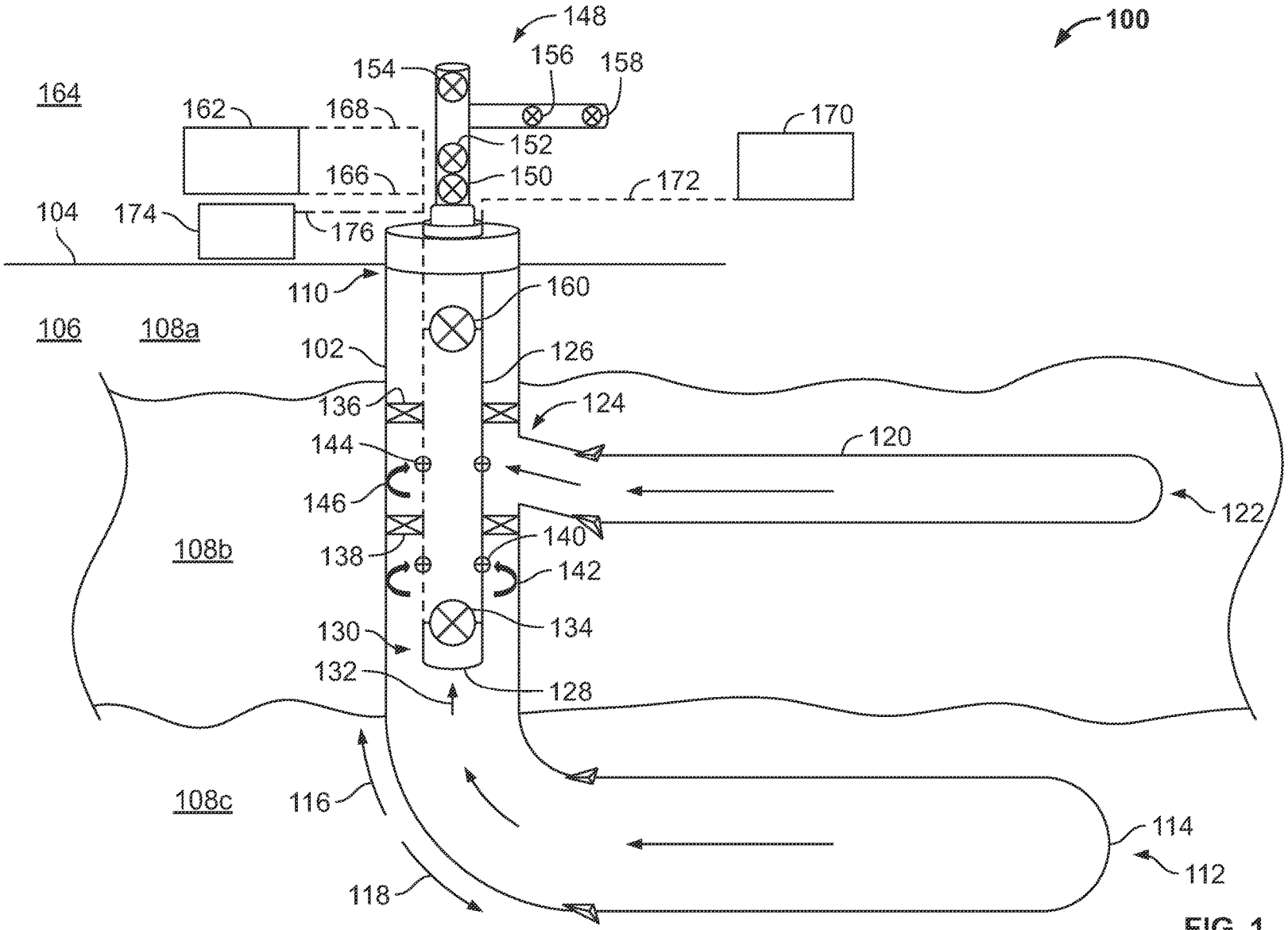
FIG. 1 is a schematic view of a multi-wellbore well system having a surface controlled formation isolation valve.

An oil and gas well has a wellbore extending from a surface of the Earth to subterranean formations in the Earth. The subterranean formations contain liquid and gaseous phases of various fluids and chemicals including water, oils, and hydrocarbon gases. The wellbore conducts the fluids and chemicals from the subterranean formations to the surface. A wellhead, formation isolation valves, inflow control valves, sub-surface safety valves, and wellhead control valves can be installed on the wellbore to seal the wellbore and to control the flow of oil and gas from the wellbore. After completing a wellbore, the formation isolation valves can be placed in a closed position forcing the liquids and gases to flow from the wellbore through the inflow control valves into a production tubing extending to the wellhead. Sometimes, the formation isolation valve needs to be opened. Opening the formation isolation valve requires stopping flowing the liquids and gases from the wellbore and deploying a shifting tool into the wellbore to the formation isolation valve to operate the formation isolation valve. For example, a coiled tubing assembly can deploy the shifting tool from the workover rig into the wellbore to actuate the formation isolation valve.

The present disclosure relates to controlling fluid flow in a multi-wellbore well system with a surface controlled formation isolation valve. In a well system requiring an intervention job, this approach controls fluid flow in the multi-wellbore well system with the surface controlled formation isolation valve controlled from a surface control panel. A control signal is transmitted from the control panel on a surface of the Earth to the surface controlled formation isolation valve positioned in the well system at a downhole location in the multi-wellbore well system. The surface controlled formation isolation valve controls a fluid flow from a motherbore into a production tubing of the well system. The surface controlled formation isolation valve receives the control signal. Based on the control signal, the surface controlled formation isolation valve operates to control the fluid flow from the motherbore into the production tubing. The intervention job is performed on the well system.

Well intervention operations (intervention jobs) are contingent to engineering analysis results of the downhole production performance. These requirements for an intervention job can arise after noticing production performance changes, introduction of water production due to prolonged production duration throughout the life of the well, and/or production enhancement treatments which require accessing the wellbore and removing all downhole restriction limiting achieving the desired depth. The intervention jobs that require full wellbore accessibility can be deployed through coiled tubing. This includes an array of well intervention operations including, but not limited to, running array production logging tools to profile downhole contribution of the wellbore beyond the production tubing depth, lifting the well with nitrogen for wellbore cleanup, treating the reservoir with acidization to enhance production performance, and running and installing downhole plugs to isolate undesired production of water or gas.

FIG. 1 is a schematic view of a multi-wellbore well system having a surface controlled formation isolation valve. The multi-wellbore well system 100 has a motherbore 102 extending from a surface 104 of the Earth 106. The Earth 106 has multiple subterranean formations: a first subterranean formation 108*a*, a second subterranean formation 108*b*, and third subterranean formation 108*c* which can contain liquid and gaseous phases of various fluids and chemicals including water, oils, and hydrocarbon gases. The motherbore 102 receives the fluids from the third subterranean formation 108*c* and conducts the fluids to the surface 104. The motherbore 102 has an uphole end 110 and a downhole end 112. The uphole end 110 of the motherbore 102 is coupled to the surface 104 and the downhole end 112 is at a bottom hole surface 114 which is located in the third subterranean formation 108*c*. The fluids flow from the third subterranean formation 108*c* into the motherbore 102 and through the motherbore 102 in an uphole direction shown by arrow 116. The uphole direction 116 is from the downhole end 112 toward the uphole end 110. A downhole direction is shown by arrow 118. The downhole direction 118 is from the uphole end 110 toward the downhole end 112.

The multi-wellbore well system 100 has a lateral wellbore 120 coupled to and extending from the motherbore 102. The lateral wellbore 120 is coupled to the motherbore 102 in the uphole direction 116 from the downhole end 112 of the motherbore 102. The lateral wellbore 120 is positioned in the second subterranean formation 108*b*. The lateral wellbore 120 receives the fluids from the second subterranean formation 108*b* and conducts the fluids to the motherbore 102. The lateral wellbore 120 has a downhole end 122 and an uphole end 124. The uphole end 124 of the lateral wellbore 120 is coupled to the motherbore 102.

The multi-wellbore well system 100 includes a production tubing 126 positioned in the motherbore 102 and extending from the surface 104 to conduct the various fluids from the motherbore 102 and the lateral wellbore 120 to the surface 104. The production tubing 126 has an opening 128 at a downhole end 130 of the production tubing 126. The fluids from the third subterranean formation 108*c* flow through the opening 128 in the direction of arrow 132 into the production tubing 126.

The multi-wellbore well system 100 includes a first packer 136 and a second packer 138 coupled between the production tubing 126 and the motherbore 102 sealing the production tubing 126 to the motherbore 102. The first packer 136 is positioned in the motherbore 102 in the uphole direction 116 from the lateral wellbore 120. The second packer 138 is positioned in the motherbore 102 in the downhole direction 118 from the lateral wellbore 120 and in the uphole direction 116 from the downhole end 130 of the production tubing 126. The first packer 136 and the second packer 138 direct the fluid from the lateral wellbore 120 (the fluid from the second subterranean formation 108*b*) into the production tubing 126 and prevent the fluid from flowing into the motherbore 102 in the downhole direction 118.

The multi-wellbore well system 100 includes a motherbore inflow control valve 140 coupled to the production tubing 126 and positioned in the motherbore 102 in the uphole direction 116 of the opening 128 of the production tubing 126 and in the downhole direction 118 from the second packer 138 to control the fluid flow from the motherbore 102 into the production tubing 126. The motherbore inflow control valve 140 can actuate between an open position allowing fluid flow from the motherbore 102 into the production tubing 126, a partially open position (a partially closed position) throttling fluid flow from the motherbore 102 into the production tubing 126, and a closed position preventing fluid flow from the motherbore 102 into the production tubing 126. The fluids from the motherbore 102 flow through the motherbore inflow control valve 140 in the direction of arrows 142 into the production tubing 126.

The multi-wellbore well system 100 includes a lateral inflow control valve 144 coupled to the production tubing 126 and positioned in the motherbore 102 in the uphole direction 116 from the second packer 138 and in the downhole direction 118 from the first packer 136 to control the fluid flow from the lateral wellbore 120 into the production tubing 126. The lateral inflow control valve 144 can actuate between an open position allowing fluid flow from the lateral wellbore 120 into the production tubing 126, a partially open position (a partially closed position) throttling fluid flow from the lateral wellbore 120 into the production tubing 126, and a closed position preventing fluid flow from the lateral wellbore 120 into the production tubing 126. The fluids from the lateral wellbore 120 flow through the lateral inflow control valve 144 in the direction of arrows 146 into the production tubing 126.

The multi-wellbore well system 100 includes a wellhead assembly 148 coupled to the motherbore 102 and the production tubing 126 at the surface 104 to seal the motherbore 102 and control the fluids flowing from the production tubing 126. The wellhead assembly 148 has a lower master valve 150 and an upper master valve 152 coupled to the lower master valve 150 to control the flow of fluids from the production tubing 126. The wellhead assembly 148 has a crown valve 154 to allow access to the motherbore 102 and the production tubing 126 through the wellhead assembly 148. The wellhead assembly 148 has a wing valve 156 and a choke valve 158 to control the fluid flow to a production or storage facility (not shown).

The multi-wellbore well system 100 includes a sub-surface safety valve 160 positioned in the production tubing 126 as a backup to stop the flow of fluid from the production tubing 126 to the surface 104. The sub-surface safety valve 160 is positioned in the uphole direction 116 from the first packer 136. The multi-wellbore well system 100 can include other sub-surface safety valves 160 positioned in other locations (not shown) throughout the motherbore 102 and the lateral wellbore 120.

The multi-wellbore well system 100 includes a surface controlled formation isolation valve 134 positioned inside of and coupled to the production tubing 126. The surface controlled formation isolation valve 134 actuates between an open position allowing fluid flow from the motherbore 102 through the production tubing 126 to the surface 104 and a closed position preventing fluid flow through the production tubing 126. The surface controlled formation isolation valve 134 acts as a bidirectional barrier to the production tubing 126 where the motherbore 102 is in the third subterranean formation 108*c* (i.e., a lower completion). During a completion operation to enhance fluid flow from the second subterranean formation 108*b*, the surface controlled formation isolation valve 134 can be placed in the closed position to prevent a pressure change in the third subterranean formation 108*c*. After the completion operation is complete, the surface controlled formation isolation valve 134 can be placed in the open position allowing fluid flow from the third subterranean formation 108*c* into the production tubing 126. In conventional operations, in order to change the position of a conventional formation isolation valve (not shown) between an open position and a closed position, producing the fluids from the multi-wellbore well system 100 is secured, and a workover rig (not shown) is positioned relative to the motherbore 102, the motherbore 102 is opened, and a shifting tool (not shown) is disposed in the motherbore 102 to actuate the conventional formation isolation valve. The position of the surface controlled formation isolation valve 134 is controlled from the surface 104.

In multilateral wells (i.e. wells drilled with several laterals downhole), the production flowrate to the production tubing 126 can be physically controlled to reduce any undesired fluid production flowrate from each lateral separately through adjusting the mechanical flow control valves 140, 144 position. To enable this control feature, the production flowrate should follow a single path into the production tubing 126. This is where the mechanical formation isolation valve 134 is required. As the production tubing 126 is manufactured as a fluid conduit; it is open from both ends (top and bottom of the production tubing 126 like a straw). The mechanical formation isolation valve 134 caps the bottom end and isolated the production tubing 126, forcing the production flowrate to pass through the mechanical formation inflow control valve 140.

The multi-wellbore well system 100 includes a control panel 162 is operatively coupled to the surface controlled formation isolation valve 134. The control panel 162 is positioned in a space 164 above the surface 104. The control panel 162 is accessible to an operator (not shown) to operate the control panel 162. The control panel 162 transmits a control signal to the surface controlled formation isolation valve 134 to actuate between the open position and the closed positon. The control signal can be an open control signal commanding the surface controlled formation isolation valve 134 to open or a close control signal commanding the surface controlled formation isolation valve 134 to close.

The control panel 162 is operatively coupled to the sub-surface safety valve 160 by a sub-surface safety valve control line 168. The operator can actuate the sub-surface safety valve 160 from the control panel 162. For example, when a safety condition is detected, the operator can manually operate the control panel 162 to send a command signal via the sub-surface safety valve control line 168 to the sub-surface safety valve 160 to shut, preventing fluid from flowing from the production tubing 126 to the wellhead assembly 148. In some case, the control panel 162 can automatically shut the sub-surface safety valve 160.

The multi-wellbore well system 100 includes a surface controlled formation isolation valve control line 166 electrically coupling the control panel 162 to the surface controlled formation isolation valve 134. The surface controlled formation isolation valve control line 166 conducts the control signal from the control panel 162 to the surface controlled formation isolation valve 134. The surface controlled formation isolation valve control line 166 can conduct a status signal from the surface controlled formation isolation valve 134 to the control panel 162 indicating the position of the surface controlled formation isolation valve 134. The surface controlled formation isolation valve control line 166 can conduct electricity from the control panel 162 to the surface controlled formation isolation valve 134. In some implementations, the surface controlled formation isolation valve control line 166 conducts a hydraulic fluid to operate the surface controlled formation isolation valve 134.

The multi-wellbore well system 100 includes a single well completion panel 170 positioned in the space 164 above the surface 104 operatively coupled to the motherbore inflow control valve 140 and the lateral inflow control valve 144 to actuate the motherbore inflow control valve 140 and the lateral inflow control valve 144 between the open position, the partially open position, and the closed position. The multi-wellbore well system 100 includes an inflow control valve line 172 operatively coupling the single well completion panel 170 to the motherbore inflow control valve 140 and the lateral inflow control valve 144. The inflow control valve line 172 conducts a control signal from the single well completion panel 170 to the motherbore inflow control valve 140 and the lateral inflow control valve 144. The inflow control valve line 172 can conduct a status signal from the motherbore inflow control valve 140 and the lateral inflow control valve 144 to the single well completion panel 170 indicating the position of the motherbore inflow control valve 140 and the lateral inflow control valve 144. The inflow control valve line 172 can conduct electricity from the single well completion panel 170 to motherbore inflow control valve 140 and the lateral inflow control valve 144. In some implementations, the inflow control valve line 172 conducts a hydraulic fluid to operate the motherbore inflow control valve 140 and the lateral inflow control valve 144.

The multi-wellbore well system 100 includes an emergency shutdown system 174 coupled to the surface controlled formation isolation valve 134 to hydraulically operate the surface controlled formation isolation valve 134 in an emergency. The emergency shutdown system 174 is hydraulically coupled to the surface controlled formation isolation valve 134 by an emergency shutdown system line 176.

Figure 2:
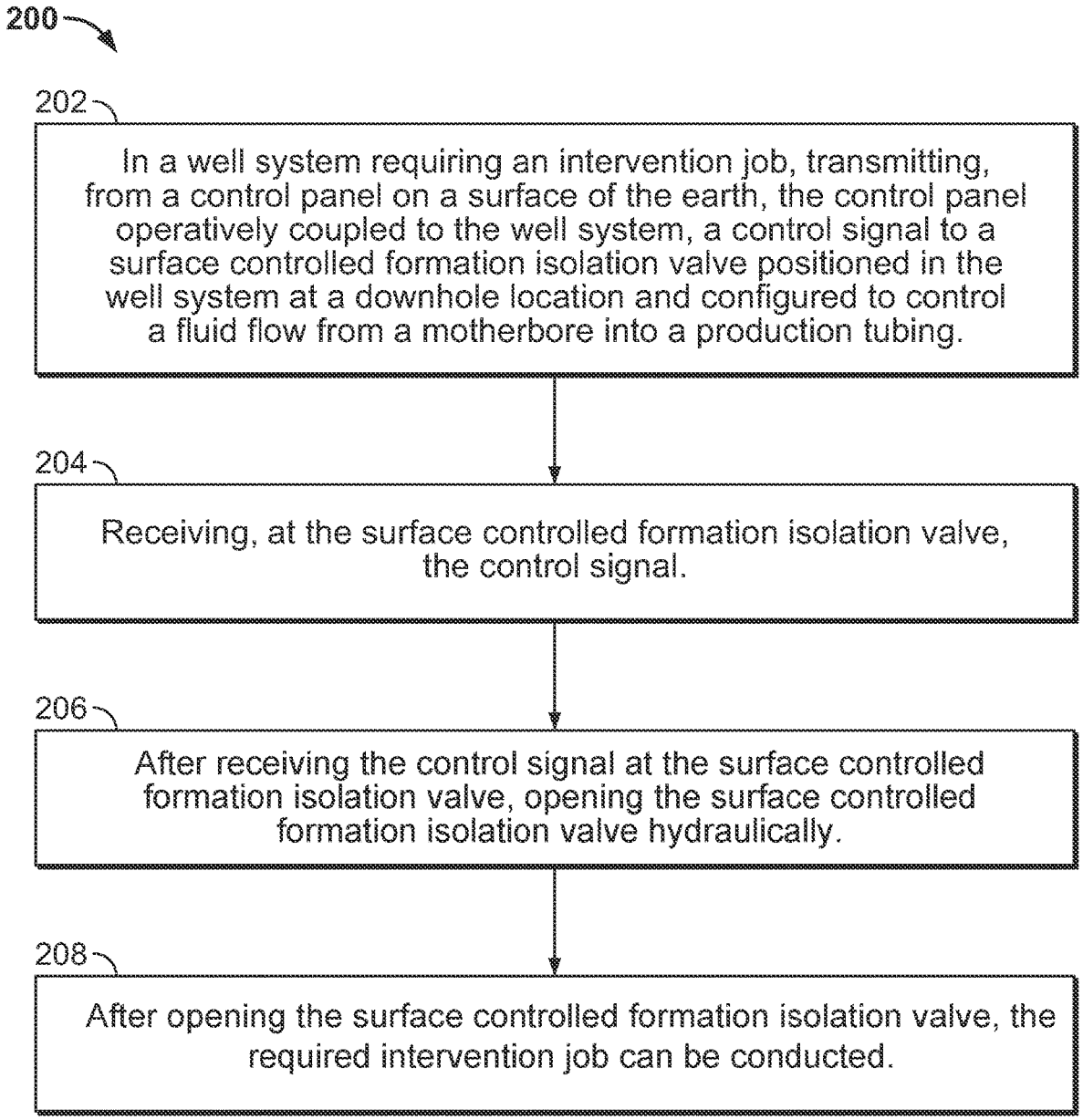
FIG. 2 is a flow chart of an example method of controlling fluid flow in a multi-wellbore well system with a surface controlled formation isolation valve according to implementations of the present disclosure.

FIG. 2 is a flow chart of an example method of controlling fluid flow in a multi-wellbore well system with a surface controlled formation isolation valve according to implementations of the present disclosure. At 202, in a multi-wellbore well system requiring an intervention job, a control signal is transmitted from a control panel on a surface of the Earth operatively coupled to the well system to a surface controlled formation isolation valve positioned in the multi-wellbore well system at a downhole location. The surface controlled formation isolation valve controls a fluid flow from a motherbore into a production tubing. For example, the control panel 162 at the surface 104 transmits the control signal to the surface controlled formation isolation valve 134. The surface controlled formation isolation valve 134 controls the fluid flow from the motherbore 102 into the production tubing 126.

In some implementations, transmitting the control signal to the surface controlled formation isolation valve includes conducting the control signal via a surface controlled formation isolation valve control line electrically coupling the control panel to the surface controlled formation isolation valve. In some cases, the control signal includes at least one of an open control signal or a close control signal. For example, the surface controlled formation isolation valve control line 166 conducts the control signal to the surface controlled formation isolation valve 134.

At 204, the control signal is received at the surface controlled formation isolation valve. For example, the surface controlled formation isolation valve 134 receives the control signal from the control panel 162 at the surface 104 via the surface controlled formation isolation valve control line 166.

At 206, after receiving the control signal at the surface controlled formation isolation valve, opening the surface controlled formation isolation valve hydraulically. Operating the surface controlled formation isolation valve responsive to receiving the open control signal at the surface controlled formation isolation valve can include opening the surface controlled formation isolation valve. For example, the surface controlled formation isolation valve 134 can be opened.

In some implementations, responsive to opening the surface controlled formation isolation valve, a flow of the fluid from one subterranean formation of the Earth is conducted through the motherbore into the production tubing positioned in the motherbore. The production tubing fluidly couples the motherbore to a wellhead positioned on the surface. For example, fluid can flow from the third subterranean formation 108*c* into the motherbore 102, through the motherbore 102, into the production tubing 126 to the wellhead assembly 148.

In some implementations, the surface controlled formation isolation valve can be operated responsive to receiving the close control signal at the surface controlled formation isolation valve which can include closing the surface controlled formation isolation valve. For example, the surface controlled formation isolation valve 134 can be closed.

In some implementations, responsive to closing the surface controlled formation isolation valve, the flow of fluid from the subterranean formation through the motherbore into the production tubing is stopped. For example, the fluid flow from the third subterranean formation 108*c* into the motherbore 102, through the motherbore 102, into the production tubing 126 to the wellhead assembly 148 can be stopped by shutting the surface controlled formation isolation valve 134. In some implementations, when the surface controlled formation isolation valve is closed, a motherbore inflow control valve positioned in the motherbore to control the flow of the fluid from the motherbore into the production tubing is operated and a lateral inflow control valve positioned in the motherbore to control a flow of another fluid from the lateral wellbore into the production tubing is operated. For example, the motherbore inflow control valve 140 and the lateral inflow control valve 144 can be opened, closed, or partially open to allow, secure, or throttle fluid flow, respectively, from the third subterranean formation 108*c* and the second subterranean formation 108*b*, respectively.

At 208, after opening the surface controlled formation isolation valve, the required intervention job can be conducted. For example, intervention jobs can include an array of well intervention operations including, but not limited to, running array production logging tools to profile downhole contribution of the wellbore beyond the production tubing depth, lifting the well with nitrogen for wellbore cleanup, treating the reservoir with acidization to enhance production performance, and running and installing downhole plugs to isolate undesired production of water or gas. Well intervention operations (intervention jobs) are contingent to engineering analysis results of the downhole production performance. These requirements for an intervention job can arise after noticing production performance changes, introduction of water production due to prolonged production duration throughout the life of the well, and/or production enhancement treatments which require accessing the wellbore and removing all downhole restriction limiting achieving the desired depth. The intervention jobs that require full wellbore accessibility can be deployed through coiled tubing.

In some implementations, another control signal is transmitted from a single well completion panel positioned at the surface of the Earth to the motherbore inflow control valve and the lateral inflow control valve via an inflow control valve line to the motherbore inflow control valve and the lateral inflow control valve to operate the motherbore inflow control valve and the lateral inflow control valve. The single well completion panel is operatively coupled to the motherbore inflow control valve and the lateral inflow control valve. The control signal can be received at the motherbore inflow control valve and the lateral inflow control valve via an inflow control valve line to the motherbore inflow control valve and the lateral inflow control valve. For example, the motherbore inflow control valve 140 and the lateral inflow control valve 144 can be operated via a control signal sent from the single well completion panel 170 via the inflow control valve line 172.

In some implementations, a safety condition is sensed in the motherbore. Responsive to sensing the safety condition in a portion of the motherbore, a sub-surface safety valve positioned in the motherbore is operated via the control panel to isolate the motherbore. For example, the control panel 162 can send a control signal to shut the sub-surface safety valve 160.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

The invention claimed is:

1. A method, in a well system requiring an intervention job, the method comprising:

transmitting, from a single well control panel on a surface of the Earth, the single well control panel operatively coupled to the well system, a close control signal to a motherbore inflow control valve positioned in the well system at a downhole location in a motherbore, the motherbore inflow control valve configured to control fluid flow from the motherbore into a production tubing extending to the surface;

receiving, at the motherbore inflow control valve, the close control signal;

responsive to receiving the close control signal at the motherbore inflow control valve, closing the motherbore inflow control valve;

transmitting, from the single well control panel, a close control signal to a lateral inflow control valve positioned in the production tubing in the motherbore at a downhole location uphole from the motherbore inflow control valve, the lateral inflow control valve configured to control fluid received in motherbore from a lateral wellbore fluidly coupled to the motherbore in the production tubing;

receiving, at the lateral inflow control valve, the close control signal;

responsive to receiving the close control signal at the lateral inflow control valve, closing the lateral inflow control valve;

transmitting, from the single well control panel on the surface of the Earth, an open control signal to a surface controlled formation isolation valve positioned in the well system at a downhole location from the motherbore inflow control valve and the lateral inflow control valve and configured to control a fluid flow from the motherbore into the production tubing;

receiving, at the surface controlled formation isolation valve, the open control signal;

after receiving the open control signal at the surface controlled formation isolation valve, opening the surface controlled formation isolation valve hydraulically; and after opening the surface controlled formation isolation valve, facilitating completion of the intervention job through the surface controlled formation isolation valve into the well system.

2. The method of claim 1, wherein transmitting the control signal to the surface controlled formation isolation valve comprises conducting the control signal via a surface controlled formation isolation valve control line electrically coupling the single well control panel to the surface controlled formation isolation valve.

3. The method of claim 1, wherein the control signal comprises at least one of an open control signal, a close control signal, a partially open control signal, or a partially close control signal.

4. The method of claim 3, wherein operating the surface controlled formation isolation valve responsive to receiving the open control signal at the surface controlled formation isolation valve comprises opening the surface controlled formation isolation valve and operating the surface controlled formation isolation valve responsive to receiving the close control signal at the surface controlled formation isolation valve comprises closing the surface controlled formation isolation valve.

5. The method of claim 4, further comprising responsive to opening the surface controlled formation isolation valve, conducting a flow of the fluid from the at least one of a plurality of subterranean formations of the Earth through the motherbore into the production tubing positioned in the motherbore, the production tubing fluidly coupling the motherbore to a wellhead positioned on the surface.

6. The method of claim 1, further comprising:

after performing the intervention job, closing, from the single well control panel, by the close control signal, the surface controlled formation isolation valve;

operating the motherbore inflow control valve positioned in the motherbore to control the flow of the fluid from the motherbore into the production tubing; and operating the lateral inflow control valve positioned in the motherbore to control a flow of another fluid from the lateral wellbore into the production tubing.

7. The method of claim 6, further comprising:

transmitting, from the single well control panel positioned at the surface of the Earth, the single well control panel operatively coupled to the motherbore inflow control valve and the lateral inflow control valve, another control signal via an inflow control valve line to the motherbore inflow control valve and the lateral inflow control valve to operate the motherbore inflow control valve and the lateral inflow control valve; and receiving, at the motherbore inflow control valve and the lateral inflow control valve via the inflow control valve line to the motherbore inflow control valve and the lateral inflow control valve, the another control signal.

8. The method of claim 1, further comprising:

sensing a safety condition in the motherbore; and responsive to sensing the safety condition in a portion of the motherbore, operating via the single well control panel, a sub-surface safety valve positioned in the motherbore to isolate the motherbore.

9. The method of claim 1, wherein responsive to closing the motherbore inflow control valve, closing the lateral inflow control valve, and opening the surface controlled formation isolation valve, defining a single path in the production tubing from a top end at the surface to a bottom end of the production tubing in the motherbore.

10. The method of claim 9, further comprising performing the intervention job in the well system through the single path and out the bottom end of the production tubing.

11. The method of claim 1, futher comprising:

after opening the surface controlled formation isolation valve, passing a coiled tubing assembly through the production tubing through the surface controlled formation isolation valve and into the motherbore, the coiled tubing assembly configured to perform the intervention job.

12. The method of claim 1, wherein the motherbore inflow control valve and the lateral inflow control valve are configured to control fluid flow from an annulus defined between the motherbore and the production tubing into the production tubing.

13. The method of claim 1, wherein the surface controlled formation isolation valve is positioned in the well system at the downhole location from the motherbore inflow control valve and the lateral inflow control valve and configured to control the fluid flow from the motherbore into the production tubing through an opening at a downhole end of the production tubing.

14. A well completion system configured to be positioned in a well system comprising a motherbore extending from a surface of the Earth into a plurality of subterranean formations, the motherbore fluidly coupled to at least one of the plurality of subterranean formations to receive a fluid from the at least one of the plurality of subterranean formations and a lateral wellbore extending from the motherbore at a location between a downhole end of the motherbore and the surface, the lateral wellbore fluidly coupled to at least another one of the plurality of subterranean formations to receive another fluid from the at least another one of the plurality of subterranean formations, the well completion system comprising:

a production tubing positioned in the motherbore, the production tubing extending from the surface through the motherbore, the production tubing comprising an opening at the downhole end of the production tubing;

a surface controlled formation isolation valve coupled to the production tubing at the downhole end of the production tubing and positioned in the motherbore to control a fluid flow into the production tubing from the motherbore through the opening at the downhole end of the production tubing;

a motherbore inflow control valve coupled to the production tubing and positioned in the motherbore uphole of the surface controlled formation isolation valve, the motherbore inflow control valve configured to control the fluid flow from the motherbore into the production tubing;

a lateral inflow control valve coupled to the production tubing and positioned in the motherbore at a downhole location uphole from the motherbore inflow control valve, the lateral inflow control valve configured to control the fluid flow of the another fluid from the lateral wellbore into the production tubing; and a single well control panel positioned in a space above the surface, the single well control panel operatively coupled to the surface controlled formation isolation valve, the motherbore inflow control valve, and the lateral inflow control valve, the single well control panel comprising a controller configured to perform operations comprising:

transmitting, from the single well control panel, a close control signal to the motherbore inflow control valve;

receiving, at the motherbore inflow control valve, the close control signal;

responsive to receiving the close control signal at the motherbore inflow control valve, closing the motherbore inflow control valve;

transmitting, from the single well control panel, a close control signal to the lateral inflow control valve;

receiving, at the lateral inflow control valve, the close control signal;

responsive to receiving the close control signal at the lateral inflow control valve, closing the lateral inflow control valve;

transmitting, from the single well control panel, an open control signal to the surface controlled formation isolation valve;

receiving, at the surface controlled formation isolation valve, the open control signal;

after receiving the open control signal at the surface controlled formation isolation valve, opening the surface controlled formation isolation valve; and after opening the surface controlled formation isolation valve, facilitating completion of an intervention job through the surface controlled formation isolation valve into the well system.

15. The well completion system of claim 14, further comprising a surface controlled formation isolation valve control line electrically coupling the single well control panel to the surface controlled formation isolation valve, the surface controlled formation isolation valve control line configured to conduct the control signal from the single well control panel to the surface controlled formation isolation valve.

16. The well completion system of claim 14, wherein control signal comprises at least one of an open control signal, a close control signal, a partially open control signal, or a partially close control signal.

17. The well completion system of claim 14, wherein the production tubing extends from the surface through the motherbore to a location downhole from the lateral wellbore.

18. The well completion system of claim 14, further comprising a wellhead assembly coupled to the motherbore at the surface, the wellhead assembly configured to control the fluid flow from the motherbore.

19. The well completion system of claim 17, further comprising:

a first packer positioned in the motherbore uphole from the lateral wellbore; and a second packer positioned in the motherbore downhole from the lateral wellbore and uphole from the surface controlled formation isolation valve.

20. The well completion system of claim 19, wherein:

the motherbore inflow control valve is positioned in the motherbore uphole of the surface controlled formation isolation valve and downhole of the second packer; and the lateral inflow control valve is positioned in the motherbore between the first packer and the second packer, wherein the first packer and the second packer control the fluid flow from the lateral wellbore through the lateral inflow control valve into the production tubing, and wherein the second packer controls the fluid flow from the motherbore through the motherbore inflow control valve into the production tubing.

21. The well completion system of claim 14, further comprising:

an inflow control valve line operatively coupling the single well control panel to the motherbore inflow control valve and the lateral inflow control valve.

22. The well completion system of claim 14, further comprising a sub-surface safety valve positioned in the motherbore to isolate a portion of the motherbore from the space above the surface.

23. The well completion system of claim 14, further comprising an emergency shutdown system coupled to the surface controlled formation isolation valve, the emergency shutdown system configured to hydraulically operate the surface controlled formation isolation valve.

24. The well completion system of claim 14, wherein responsive to closing the motherbore inflow control valve, closing the lateral inflow control valve, and opening the surface controlled formation isolation valve, defining a single path in the production tubing from a top end at the surface past the motherbore inflow control valve and the lateral inflow control valve, through the surface controlled formation isolation valve, to a bottom end of the production tubing, and out the opening at the downhole end of the production tubing into the motherbore.

* * * * *